United States Patent [19]

Nagashima et al.

[11] Patent Number: 4,478,200

[45] Date of Patent: Oct. 23, 1984

[54] ELECTRONIC IGNITION SYSTEM FOR INTERNAL COMBUSTION ENGINE CAPABLE OF SUPPLYING ELECTRIC POWER TO AUXILIARY UNIT

[75] Inventors: Akira Nagashima, Kawasaki; Tadashige Kondo, Tokyo, both of Japan

[73] Assignee: Kioritz Corporation, Japan

[21] Appl. No.: 451,660

[22] Filed: Dec. 21, 1982

[30] Foreign Application Priority Data

Dec. 29, 1981 [JP] Japan ..... 56-211609

[51] Int. Cl.[3] ..... F02P 3/06

[52] U.S. Cl. ..... 123/605; 123/596; 123/599

[58] Field of Search ..... 123/596, 597, 599, 602, 123/605

[56] References Cited

U.S. PATENT DOCUMENTS

| | | | |
|---|---|---|---|
| 3,421,069 | 1/1969 | Minks | 123/597 |
| 3,553,725 | 1/1971 | Miki | 123/599 |
| 3,619,634 | 11/1971 | Burson | 123/602 |
| 3,974,816 | 8/1976 | Henderson et al. | 123/599 |
| 4,170,206 | 10/1979 | Katsumata et al. | |
| 4,184,467 | 1/1980 | Kato et al. | |
| 4,213,436 | 7/1980 | Burson | |
| 4,216,756 | 8/1980 | Mura | 123/597 |
| 4,259,938 | 4/1981 | Johansson | |

FOREIGN PATENT DOCUMENTS

| | | | |
|---|---|---|---|
| 2639794 | 3/1977 | Fed. Rep. of Germany | 123/596 |

*Primary Examiner*—Parshotam S. Lall

*Attorney, Agent, or Firm*—Karl W. Flocks; Sheridan Neimark; A. Fred Starobin

[57] ABSTRACT

An electronic ignition system of the capacitor-discharge type for an internal combustion engine includes a magneto generator having substantially a single generating coil with no center tap, and includes a change-over circuit which changes over the supply of power generated from the generating coil from the capacitor to an auxiliary unit when the capacitor is charged to a given voltage by the half-waves of one polarity of the alternating electromotive force generated in the generating coil. The opposite-polarity half-waves of the alternating electromotive force are supplied to the auxiliary unit even while the capacitor is being charged.

3 Claims, 2 Drawing Figures

Figure 1:
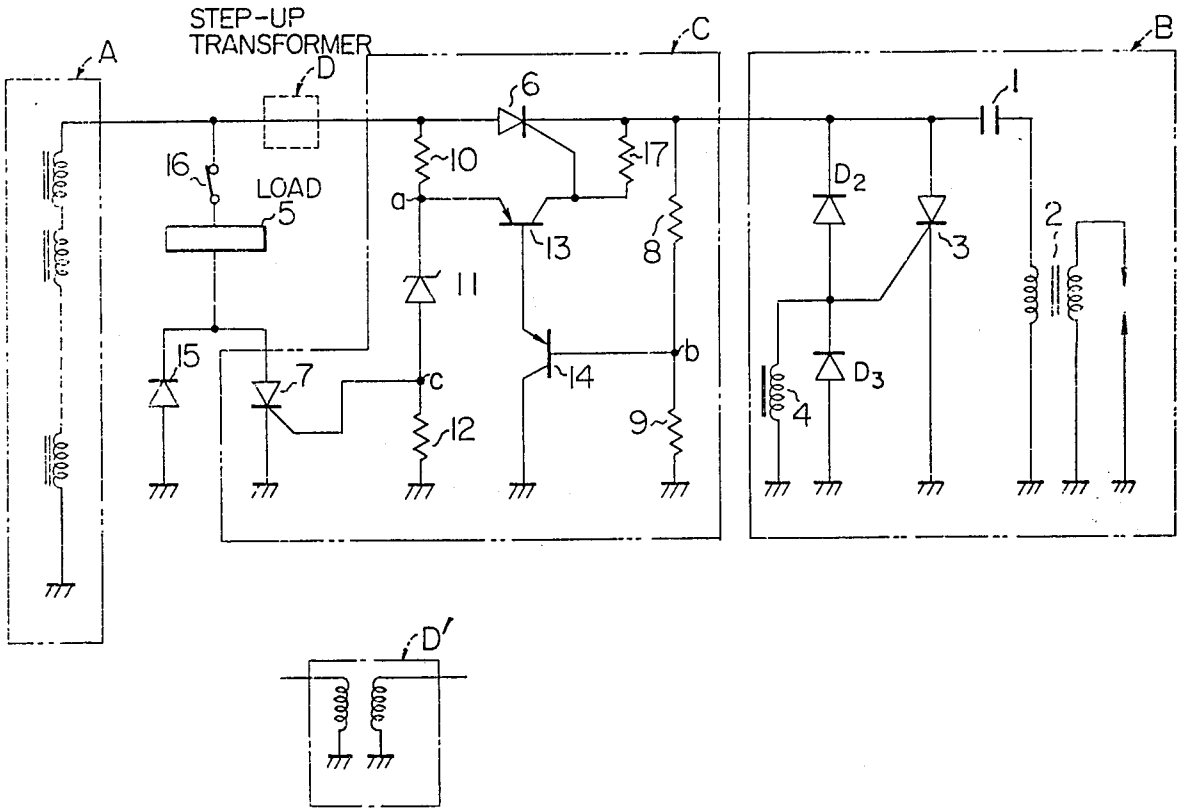

ELECTRONIC IGNITION SYSTEM FOR INTERNAL COMBUSTION ENGINE CAPABLE OF SUPPLYING ELECTRIC POWER TO AUXILIARY UNIT

The present invention relates to internal combustion engine electronic ignition systems of the capacitor-discharge type including a magneto generator, and more particularly the invention relates to electronic ignition system for an internal combustion engine capable of also supplying the electromotive force generated by a magneto generator to any auxiliary unit.

With this type of electronic ignition system having a magneto generator, it has been the practice so that where the electromotive force generated by the magneto generator must be supplied not only for engine ignition purposes but also to any other electrical load unit, e.g., an auxiliary unit or other electrical devices such as the handle heater of a chain saw or an illuminator, the power is taken out by using the magnet rotor of the magneto generator in common, using the magnet rotor and the magneto or generating coil core in common and additionally providing a separate generating coil or providing the conventional generating coil with a center tap.

However, the addition of a separate generating coil, i.e., the use of two different generating coils or the provision of a center tap complicates the construction of the magneto generator and increases its manufacturing steps with the resulting increase in the cost. Particularly, where the magneto generator must be provided with multiple poles and small in size, it is difficult for the known ignition systems to meet these requirements since two different multipole generating coils or a center tap is required with the resulting complication of the construction and increase in size.

It is therefore the primary object of the present invention to provide a capacitor-discharge type electronic ignition system capable of supplying electric power to any other auxiliary unit in addition for engine ignition purposes without any modification of the conventional magneto generator.

In accordance with the present invention there is thus provided a capacitor-discharge type electronic ignition system in which a generating coil of a magneto generator comprises substantially a single coil having no center tap and a change-over circuit is provided so that when a capacitor adapted to be charged by the half-wave of one polarity of an alternating electromotive force generated in the generation coil is charged to a given voltage required for igniting the engine a change-over is effected from the supply of power to the capacitor to the supply of power to a load (auxiliary unit) connected to the output terminal of the generating coil.

Thus, each time the ignition of the engine is completed the generated electromotive force of the magneto generator is supplied to an ignition circuit for capacitor charging purposes so that when the charged voltage of the capacitor reaches a given voltage, the supply of the generated electromotive force is changed over from one path to another and the power is supplied to the load. This eliminates the need to add to the conventional magneto generator a separate generating coil for supplying the power to the load or the need to provide the generating coil with a power takeout center tap and permits effective use of the conventional magneto generator for ignition purposes and supplying the power to the auxiliary unit without any modification.

Further, the power supply path from the magneto generator to the load includes a diode connected in parallel with a control element for controlling the opening and closing of the supply path so that the diode is turned on by the half-wave electromotive force of the generated alternating electromotive force of the magneto generator which is opposite in polarity to the half-wave electromotive force used for capacitor charging purposes and the half-wave electromotive force of the opposite polarity is supplied to the load even during the charging of the capacitor thereby utilizing the generated electromotive force more effectively. Still further, the use of a generating coil comprising a single coil having no center tap simplifies the manufacture of small and multipole magneto generators.

Figure 2:
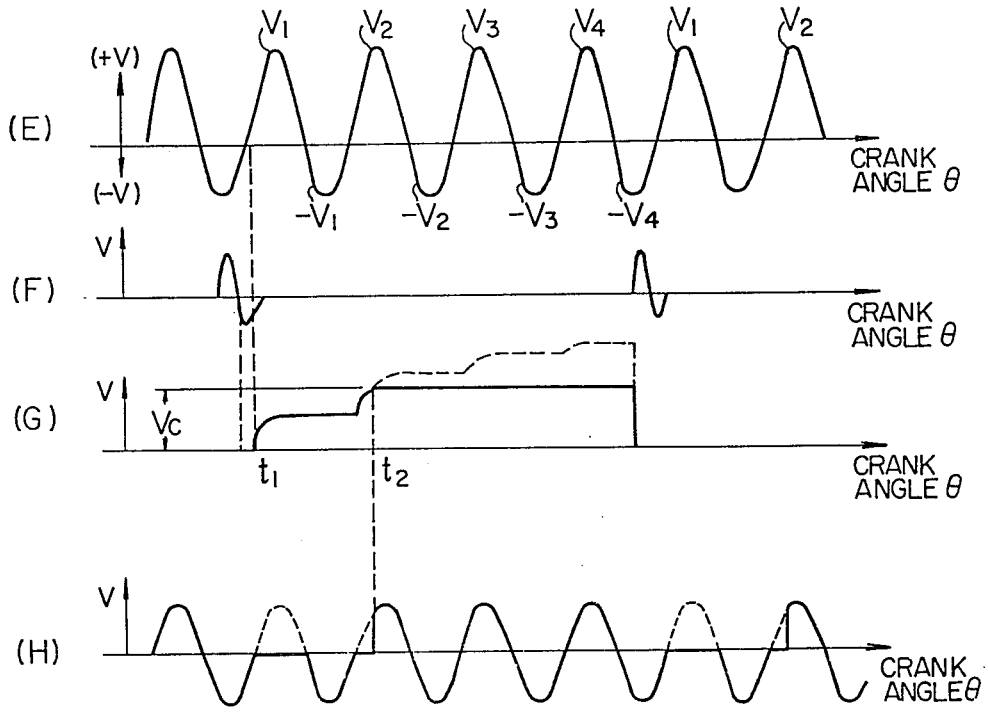

A preferred embodiment of the invention will now be described with reference to the drawings, in which:

FIG. 1 shows a circuit diagram of an electronic ignition system according to the invention; and FIG. 2 shows waveforms of signals developed at various parts in the circuit of FIG. 1.

Referring to FIG. 1, a block A designates a magneto generator whose generating coil portion alone is shown and the coil comprises substantially a single coil having no center tap. A block B designates a known electronic ignition circuit section comprising a charging capacitor 1, an ignition coil 2, an ignition controlling thyristor 3 and an ignition signal generating coil 4. A block C designates a circuit for changing over the supply of the generated electromotive force of the generating coil A between the capacitor 1 and an electrical load 5, and the circuit includes an SCR 6 connected in the charging path from the generating coil A to the capacitor 1 to control the opening and closing thereof, an SCR 7 inserted in the power supply path from the generating coil A to the load 5 to control the opening and closing thereof, a voltage divider circuit having resistors 8 and 9 to divide the charged capacitor voltage and to generate the resulting voltage at a junction point b, and a circuit having a resistor 10, a Zener diode 11 and a resistor 12 connected in series for establishing at a point a (a junction between the resistor 10 and Zener diode 11) a reference voltage used for detecting a given capacitor voltage required for ignition purposes. The voltage divider circuit (8, 9) has one end connected between the SCR 6 and the capacitor 1 and has the other end connected to ground. The reference establishing circuit (10, 11, 12) has one end connected between the generating coil A and the SCR 6 and has the other end connected to ground. Included further are transistors 13 and 14 which are turned on and off in accordance with the magnitude of the voltages at the points a and b to apply a control signal to the SCR 6. The transistor 13 has the emitter-collector circuit connected between the junction point a and the gate electrode of the SCR 6 and a resistor 17 is connected between the gate and cathode of the SCR 6. The transistor 14 has the emitter-collector circuit connected between the base of the transistor 13 and ground, and the base of the transistor 14 is connected to the junction point b of the voltage dividing circuit. The other SCR 7 connected in series with the load 5 is controlled by the current that flows through the Zener diode 11 when the transistors 13 and 14 are turned off. If, for example, the engine is used for driving a chain saw, the load 5 may be comprised of an auxiliary unit such as an electric heater mounted inside the handle of the chain saw or an illuminator for lighting. A diode 15 is connected in parallel with the SCR 7 to pass the half-wave electromotive force which is opposite in polarity to the half-wave electromotive force for charging the capacitor 1. A switch 16 is connected in series with the load 5 and the switch 16 which is usually closed is adapted to disconnect the load 5 when there is no need to supply power to the load 5.

The operation of the electronic ignition system will now be described with reference to the waveform diagram of FIG. 2 together with FIG. 1. If the magneto generator has a plurality of poles, e.g., eight poles, the number of cycles per engine revolution of the alternating electromotive force generated in the generating coil A is four and half-wave electromotive forces $V_1$ to $V_4$ (no-load voltages or virtual electromotive forces) are generated as shown in (E) of FIG. 2. In synchronism with these half-wave electromotive forces the ignition signal coil 4 generates pulse signals at the rate of one for every revolution of the engine as shown in (F) of FIG. 2. Assuming now that the capacitor 1 of the ignition circuit B is just after the discharge thereof (just after the ignition) and has no stored charge, the current caused by one polarity of the alternating electromotive force generated in the generating coil A, e.g., the positive-phase electromotive force flows to the ground through the resistor 10, the emitter-base circuit of the transistor 13, the emitter-base circuit of the transistor 14 and the resistor 9 in the power supply change-over circuit C. In this condition, the voltage at the point a is higher than the voltage at the voltage dividing point b for the charged capacitor voltage. When the transistor 13 is turned on, the current from the generating coil A flows through the resistor 10, the transistor 13 and the gate-cathode circuit of the SCR 6, and the SCR 6 is turned on thereby charging the capacitor 1. In FIG. 2, the charge starting time of the capacitor 1 by the half-wave electromotive force $V_1$ of the generating coil A is shown substantially the same with the time at which $V_1$ starts rising (see (E) and (G) in FIG. 2).

In this case, while, in the prior art ignition system, the charge due to all of the half-wave electromotive forces $V_1$, $V_2$, $V_3$ and $V_4$ generated in the generating coil A is stored in the capacitor 1, in accordance with the present invention the charging is stopped when the required energy for ignition is stored in the capacitor 1 or when the capacitor voltage charged by the half-wave $V_1$ and a part of the half-wave $V_2$ reaches a voltage $V_C$ in (G) of FIG. 2. Thus, if the Zener voltage $V_Z$ of the Zener diode 11 is selected such that the voltage $V_b$ at the point b produced by dividing the charged capacitor voltage $V_c$ through the resistors 8 and 9 becomes equal to the voltage $V_a$ at the point a determined by the resistor 10, the Zener diode 11 and the resistor 12, when $V_a=V_b$, no base current flows to the transistors 13 and 14 and thus the transistors 13 and 14 (the emitter-collector circuits) are turned off. Consequently, the SCR 6 is turned off and the charging of the capacitor 1 is stopped. In this case, if the half-wave $V_2$ has a remaining capability to rise further or if the next half-wave $V_3$ is generated, the voltage at the point a becomes higher than the Zener voltage $V_Z$ and the current from the generating coil A flows to the gate-cathode circuit of the SCR 7 through the resistor 10 and the Zener diode 11. As a result, the SCR 7 is turned on so that the charging of the capacitor 1 is stopped at a time $t_2$ and simultaneously the power is supplied to the load 5. In this case, the electromotive force is supplied from the generating coil A to the load 5 as shown in (H) of FIG. 2 and this represents the case where the diode 15 is connected in parallel with the SCR 7 so that the half-wave of the opposite polarity to the capacitor charging half-wave is supplied continuously even during the capacitor charging period $t_1$ to $t_2$.

Thus, irrespective of whether the switch 16 is on or off, so far as $V_a \leqq V_b$ the SCR 6 is not turned on by the electromotive force following $V_2$ and the charged voltage of the capacitor 1 is not increased.

When the electromotive force generated in the generating coil A proceeds to $V_3$ and $V_4$ so that the next ignition signal (see (F) of FIG. 2) is generated, the ignition control thyristor 3 is turned on and the charge on the capacitor 1 is discharged through the thyristor 3 and the primary winding of the ignition coil 2 thereby igniting the engine. When the capacitor 1 is discharged, the initial condition is restored and the charging is started again by the half-wave $V_1$ of the next cycle.

As described above, the positive-phase half-waves of the electromotive force generated in the generating coil A are first supplied to the ignition circuit B through the change-over circuit C and after supplying the power sufficiently to the capacitor 1 the power supply is changed over by the change-over circuit C so as to supply the power to the load 5.

With this power supply change-over method, the power supplied to the load 5 is devoid of the dotted-line half-wave portions as shown in (H) of FIG. 2 during the capacitor charging period $t_1$ to $t_2$, and thus half-wave intermittent alternating power is supplied. However, excepting cases where a perfect alternating power is required in consideration of the nature of loads, from the practical point of view this power is sufficient for the ordinary loads such as the handle heaters of chain saws and illuminators.

Further, by virtue of the fact that the supply of power is changed over from one path to another automatically through the change-over circuit C by detecting the charged voltage of the capacitor 1, even if the magnitude and frequency of the electromotive force generated in the generating coil A are changed due to changes in the engine speed, not only the storage of the required ignition power in the capacitor 1 of the ignition circuit B is ensured satisfactorily but also the power generated during the time other than the charging period (the half-wave power of the opposite polarity during the charging period is included if the diode 15 is used) is supplied to the load 5 thereby effectively utilizing the generated electromagnetic force of the magneto generator. Note that if the generated electromotive force of the generating coil A varies, the charging of the capacitor 1 will not always be completed by the half-wave $V_2$ as shown by the solid line in (G) of FIG. 2 and it may be completed earlier by the half-wave $V_1$ or later by the half waves $V_3$ and $V_4$. The dotted line shows the extreme case where the charging is completed by the half-wave $V_4$. In this case, only the opposite polarity half-wave is supplied to the load.

Where the generating coil A is required to generate an electromotive force lower than that supplied to the ignition circuit B depending on the type of the load 5, a step-up transformer may be used as indicated by a block D (D') so as to supply a higher voltage to the ignition circuit B.

We claim:

1. An electronic ignition system of the capacitor discharge type for an internal combustion engine comprising:

a magneto generator including substantially a single generating coil for generating an alternating electromagnetic force in synchronism with the rotation of said engine;

an electronic ignition circuit including a capacitor connected to said single generating coil and charged by a half-wave of one polarity of said alternating electromagnetic force, and an ignition controlling thyristor in response to an ignition signal generated in an ignition signal generating coil for controlling the discharge of said capacitor to flow a discharge current through a primary winding of an ignition coil;

an electrical load circuit adapted to be connected to said generating coil in parallel with said electronic ignition circuit; and a change over circuit connected between said generating coil and said electronic ignition circuit and between said generating coil and said electrical load circuit, said change over circuit detecting that said capacitor of said electronic ignition circuit is charged at a predetermined level and changing over the supply of said alternating electromagnetic force generated by said generating coil from said capacitor to said electric load circuit.

2. An electronic ignition system according to claim 1, wherein said change over circuit includes:

a first switching element connected between said signal generating coil and said capacitor, p1 a second switching element connected in series with said electrical load circuit, and a detection circuit for detecting a charged voltage of said capacitor and for controlling said first and second switching elements such that said first switching element is rendered conductive and said second switching element non-conductive until the charged voltage of said capacitor reaches a predetermined voltage level to supply the alternating electromagnetic force to said capacitor and when the charged voltage reaches the predetermined voltage level, said first switching element is rendered non-conductive and said second switching element conductive thereby to supply the alternating electromagnetic force to said load circuit.

3. An ignition system according to claim 2, wherein a diode is connected in parallel with said second switching element whereby a half-wave of said alternating electromotive force which is opposite in polarity to said one-polarity half-wave charging said capacitor is supplied to said load during the charging of said capacitor.

* * * * *